United States Patent [19]

Fick

[11] 4,362,399

[45] Dec. 7, 1982

[54] CIRCUIT FOR AN ELECTRONIC CLOCK HAVING A PARALLEL-CONNECTED ALARM DEVICE AND STEPPER MOTOR

[75] Inventor: Franz Fick, Hamburg, Fed. Rep. of Germany

[73] Assignee: U.S. Philips Corporation, New York, N.Y.

[21] Appl. No.: 193,211

[22] Filed: Oct. 2, 1980

[30] Foreign Application Priority Data

Oct. 12, 1979 [DE] Fed. Rep. of Germany ..... 2941388

[51] Int. Cl.[3] ..... G04C 21/16

[52] U.S. Cl. ..... 368/255; 368/73; 368/250

[58] Field of Search ..... 368/72, 73, 74, 76, 368/88, 250, 251, 255, 259, 260, 107, 109, 244

[56] References Cited

U.S. PATENT DOCUMENTS

| | | | |
|---|---|---|---|
| 2,752,592 | 6/1956 | Gallagher et al. | 368/259 |
| 3,004,179 | 10/1961 | Chartier et al. | 368/259 |
| 3,158,986 | 12/1964 | Haydon | 368/259 |
| 3,318,084 | 5/1967 | Patrick | 368/250 |
| 3,341,841 | 9/1967 | Stampfli | 368/244 |

FOREIGN PATENT DOCUMENTS

| | | | |
|---|---|---|---|
| 55-82084 | 6/1980 | Japan | 368/72 |

*Primary Examiner*—Bernard Roskoski

*Attorney, Agent, or Firm*—Thomas A. Briody; Robert T. Mayer; Steven R. Biren

[57] ABSTRACT

In an electronic clock circuit having both a stepper motor and a PXE (piezoelectric oxide) alarm element, the stepper motor and PXE element are connected in parallel and appropriate motor and PXE drive signals are provided on the same line. With this circuit configuration, an inductance and a transistor are eliminated from the prior art circuit, thus resulting in a smaller and less expensive device.

2 Claims, 2 Drawing Figures

CIRCUIT FOR AN ELECTRONIC CLOCK HAVING A PARALLEL-CONNECTED ALARM DEVICE AND STEPPER MOTOR

BACKGROUND OF THE INVENTION

The invention relates to a circuit arrangement for an electronic clock with an alarm device, comprising a stepper motor, driven by a quartz oscillator with an associated frequency divider, which stepper motor drives the display elements, and comprising a PXE (piezoelectric oxide) element which generates the alarm signal.

Such circuit arrangements are generally known. FIG. 1 shows an example of one such prior art circuit. An electronic circuit 1, which is not shown in more detail, generally an integrated circuit (IC), in conjunction with a quartz resonator 2 and a voltage source 3, generates a constant frequency, which after multiple division supplies a second-pulse to a stepper motor 4, which moves the display elements, not shown, for example the hands. A switch 5, which is mechanically coupled to the hour-hand, actuates an alarm device at a preset time, which device in the present example comprises an inductance 6, a PXE (piezoelectric oxide) element 7, and a transistor 8. When the switch 5 is closed at the preset alarm time, a frequency of 4.194 kHz, derived from the frequency divider, is applied to the base of the transistor 8, so that the PXE (piezoelectric oxide) element 7 (electromechanical piezoelectric oxide transducer) generates audible vibrations, the inductance 6 constituting the d.c. path for the transistor 8.

The control pulses for the stepper motor 4 may, for example, have a duration of 1/32 sec., as is indicated in FIG. 1 at the bottom right.

SUMMARY OF THE INVENTION

It is an object of the present invention to simplify a circuit arrangement of this type in such a way that the inductance 6 and the transistor 8 may be dispensed with. According to the invention this is achieved by connecting the PXE element in parallel with the winding of the stepper motor and by providing the frequency divider with a switch, which upon closure in the interval between every two stepping pulses supplies the frequency required for driving the PXE element in the parallel arrangement of the motor winding and the PXE element.

It is apparent that the resonant frequency of the PXE element 7 and the derived frequency of 4.194 kHz should correspond in order to obtain optimum efficiency.

It has been found that the d.c. pulse of 1/32 sec. duration required for controlling the motor 4 does not influence the PXE element 7, while on the other hand the stepper motor 4 is not influenced by the high frequency.

DETAILED DESCRIPTION

Figure 2:
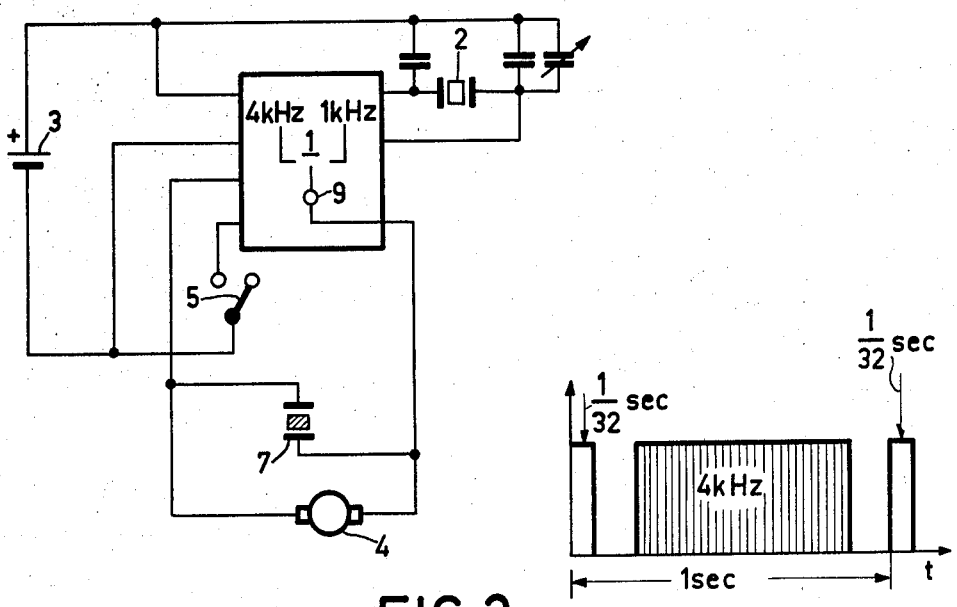
FIG. 2 shows a schematic and waveform diagram of a circuit for an electronic clock in accordance with the invention.

FIG. 2 shows an embodiment of a circuit arrangement in accordance with the invention. This embodiment again comprises an integrated circuit 1, a quartz resonator 2, a voltage source 3, a motor 4 and a contact 5. As can be seen, the PXE (piezoelectric oxide) element 7 is connected in parallel with the winding of the stepper motor 4. The integrated circuit 1 includes a switch 9, which—after closure of the contact 5—in the interval between every two control pulses for the stepper motor supplies a voltage having a frequency of 4.194 kHz to the parallel connection of the stepper motor 4 and the PXE element 7. The corresponding pulse diagram is shown in FIG. 2 at the bottom right.

Figure 1:
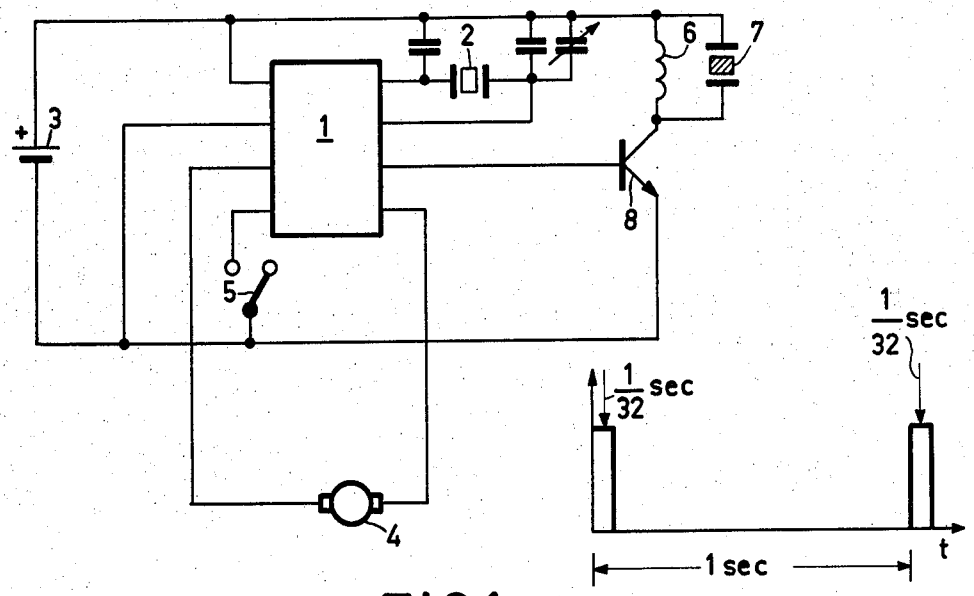
FIG.1 PRIOR ART
FIG. 1 shows a schematic and waveform diagram of a prior-art circuit for an electronic clock.

When the circuit proposed by the invention is used, inductance 6 and transistor 8, as used in FIG. 1, may be dispensed with, for a considerable saving in size and cost.

What is claimed is:

1. A circuit for an electronic clock having display elements and an alarm device, which comprises:

a quartz oscillator;

a stepper motor for driving the display elements;

a PXE alarm element connected in parallel with said stepper motor;

a frequency divider having its input coupled to said quartz oscillator and its output coupled to the parallel combination of said stepper motor and said alarm element; and means for switching the output frequency of said divider from a first frequency for providing stepping pulses to said motor to a second frequency for driving said parallel-connected PXE element during the time interval between said stepping pulses.

2. A circuit as in claim 1, wherein the resonant frequency of said PXE element corresponds to said second frequency.

* * * * *